US005992765A

United States Patent [19]

Smith

[11] Patent Number: 5,992,765

[45] Date of Patent: Nov. 30, 1999

[54] MECHANICAL BREAK-UP FOR SPRAY ACTUATOR

[75] Inventor: Jeremy P. Smith, Louden, N.H.

[73] Assignee: Summit Packaging Systems, Inc., Manchester, N.H.

[21] Appl. No.: 09/065,549

[22] Filed: Apr. 24, 1998

[51] Int. Cl.[6] ..... B05B 1/34

[52] U.S. Cl. ..... 239/493; 239/337

[58] Field of Search ..... 239/491, 492, 239/337

[56] References Cited

U.S. PATENT DOCUMENTS

| | | | |
|---|---|---|---|
| 1,440,705 | 1/1923 | Sumner . | |
| 1,493,150 | 5/1924 | Deming . | |
| 1,833,108 | 11/1931 | Camerino . | |
| 2,248,728 | 7/1941 | Strosk | 299/120 |
| 2,767,023 | 10/1956 | Venus, Jr. | 299/114 |
| 3,112,074 | 11/1963 | Green | 239/493 |
| 3,192,611 | 7/1965 | Briechle | 29/157 |
| 3,519,210 | 7/1970 | Du Plain | 239/492 |
| 3,570,770 | 3/1971 | Ewald | 239/337 |
| 3,652,018 | 3/1972 | Focht | 239/490 |
| 3,785,571 | 1/1974 | Hoening | 239/337 X |
| 4,020,979 | 5/1977 | Shay et al. | 222/211 |
| 4,036,439 | 7/1977 | Green | 239/493 X |
| 4,071,196 | 1/1978 | Burke et al. | 239/492 |
| 4,074,861 | 2/1978 | Magers et al. | 239/492 |
| 4,111,367 | 9/1978 | Hayes | 239/333 |
| 4,122,982 | 10/1978 | Giuffredi | 239/337 X |
| 4,189,099 | 2/1980 | Bruninga | 239/200 |
| 4,247,049 | 1/1981 | Gailitis | 239/497 |
| 4,251,032 | 2/1981 | Werding | 239/323 |
| 4,515,315 | 5/1985 | Corsette | 239/491 |
| 4,583,692 | 4/1986 | Sheffler et al. | 239/405 |
| 5,064,122 | 11/1991 | Kamishita et al. | 239/396 |
| 5,147,087 | 9/1992 | Fuchs | 239/337 X |
| 5,267,692 | 12/1993 | Maas et al. | 239/333 |
| 5,458,289 | 10/1995 | Cater | 239/119 |
| 5,526,985 | 6/1996 | Martin | 239/478 |
| 5,540,389 | 7/1996 | Knickerbocker | 239/491 |
| 5,622,318 | 4/1997 | Bougamont et al. | 239/490 |
| 5,639,029 | 6/1997 | Sundholm | 239/488 |
| 5,769,325 | 6/1998 | Jouillat et al. | 239/337 |

*Primary Examiner*—Lesley D. Morris
*Attorney, Agent, or Firm*—Davis and Bujold

[57] ABSTRACT

A spray actuator which has an inlet which communicates with a discharge orifice outlet via a passageway and a discharge cavity. The discharge cavity accommodates a central post therein which supports a plurality of axial fins that may be each provided with stop shoulder. An insert member, carrying a discharge orifice, is received within the discharge cavity and engages with the support fins and the stop shoulders. The insert member is provided with an annular lip which has an interference fit with the inner side wall, defining the discharge cavity, to retain permanently the insert member within the discharge cavity. An end face of the side wall of the insert member abuts against the stop shoulders to prevent overinsertion of the insert member into the discharge cavity and thereby prevent inadvertent deformation or crushing of the mechanical break-up. An end face of the central post has a mechanical break-up molded therein which impart a tangential spin to pressurized product as the product flow therethrough.

16 Claims, 3 Drawing Sheets

MECHANICAL BREAK-UP FOR SPRAY ACTUATOR

FIELD OF THE INVENTION

The present invention relates to an improved mechanical break-up for a spray actuator which prevents crushing, distortion and/or deformation of the mechanical break-up during the manufacturing process of the spray actuator.

BACKGROUND OF THE INVENTION

One major the problem associated with the known prior art mechanical break-ups, for aerosol spray actuators, is that the mechanical break-ups are frequently crushed, deformed or distorted during the manufacturing process. Such crushing, deformation and/or distortion of the mechanical break-up causes an alteration of the product flow characteristics, through supply passages provided in the mechanical break-up, and thus the discharge characteristics of the product from the discharge orifice of the spray actuator. If the mechanical break-up is significantly crushed, deformed or distorted, adequate flow of product through the mechanical break-up may be significantly restricted or prevented. Therefore, such alteration is undesirable and should be avoided.

SUMMARY OF THE INVENTION

Wherefore, it is an object of the present invention to overcome the aforementioned problems and drawbacks associated with the prior art designs.

Another object of the invention is to provide an improved mechanical break-up for a spray actuator which prevents or minimizes the compression, deformation and/or distortion of the mechanical break-up during the assembly process.

Still another object of the invention is to simplify the production of the mechanical break-up by forming the mechanical break-up on an end face of a cylindrical post located within a discharge cavity.

Yet another object of the invention is minimize the height dimension of the mechanical break-up as well as the height dimension of the insert member to miniaturize the mechanical break-up.

A still further object of the invention is to provide an improved spray actuator, for hair spray application, which emits product of a desired particle size and softness while reducing the associated sound generated upon discharge of the pressurized product from the spray actuator.

The present invention relates to a spray actuator for dispensing a pressurized product, said spray actuator comprising a housing having an inlet communicating with a discharge orifice via a passageway and a discharge cavity; said discharge cavity being opened at one end and having a post located therein, said post supporting a plurality of fins, and at least one of said fins preferably has a shoulder located remote from said opened end; an end face of said post supporting a mechanical break-up having a plurality of radially extending supply passages for providing a tangential flow to product as the product passes therethrough; and an insert member having said discharge orifice formed therein, said insert member being received within the opened end of said discharge cavity and having an interference fit with said discharge cavity to seal said discharge cavity, and said insert member abutting against said mechanical break-up to facilitate product flow through said mechanical break-up and out through said discharge orifice.

The present invention also relates to a method for dispensing a pressurized product, said spray actuator comprising providing a housing having an inlet communicating with a discharge orifice via a passageway and a discharge cavity; forming said discharge cavity to be opened at one end and having a post located therein, and providing a plurality of fins on said post with at least one of said fins preferably having a shoulder; forming a mechanical break-up on an end face of said post, said mechanical break-up having a plurality of radially extending supply passages for providing a tangential flow to product as the product flows therethrough; inserting an insert member, having said discharge orifice formed therein, within the opened end of said discharge cavity, said insert member having an interference fit with said discharge cavity to seal said discharge cavity, and said insert member being sufficiently inserted into said discharge cavity to abut against said mechanical break-up to facilitate product flow through said mechanical break-up.

It is to be appreciated that in some applications none of the fins will carry a shoulder, located remote from the opened end, to prevent over-insertion of the insert member into the discharge cavity.

BRIEF DESCRIPTION OF THE DRAWINGS

The invention will now be described, by way of example, with reference to the accompanying drawings in which.

DESCRIPTION OF THE PREFERRED EMBODIMENTS

Figure 2:
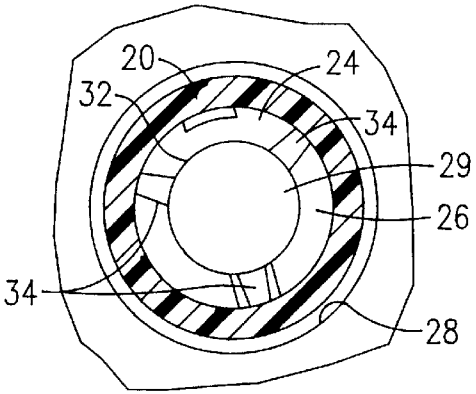
FIG. 2 is a partial diagrammatic cross-sectional view along section line 2—2 of FIG. 1.
Figure 1:
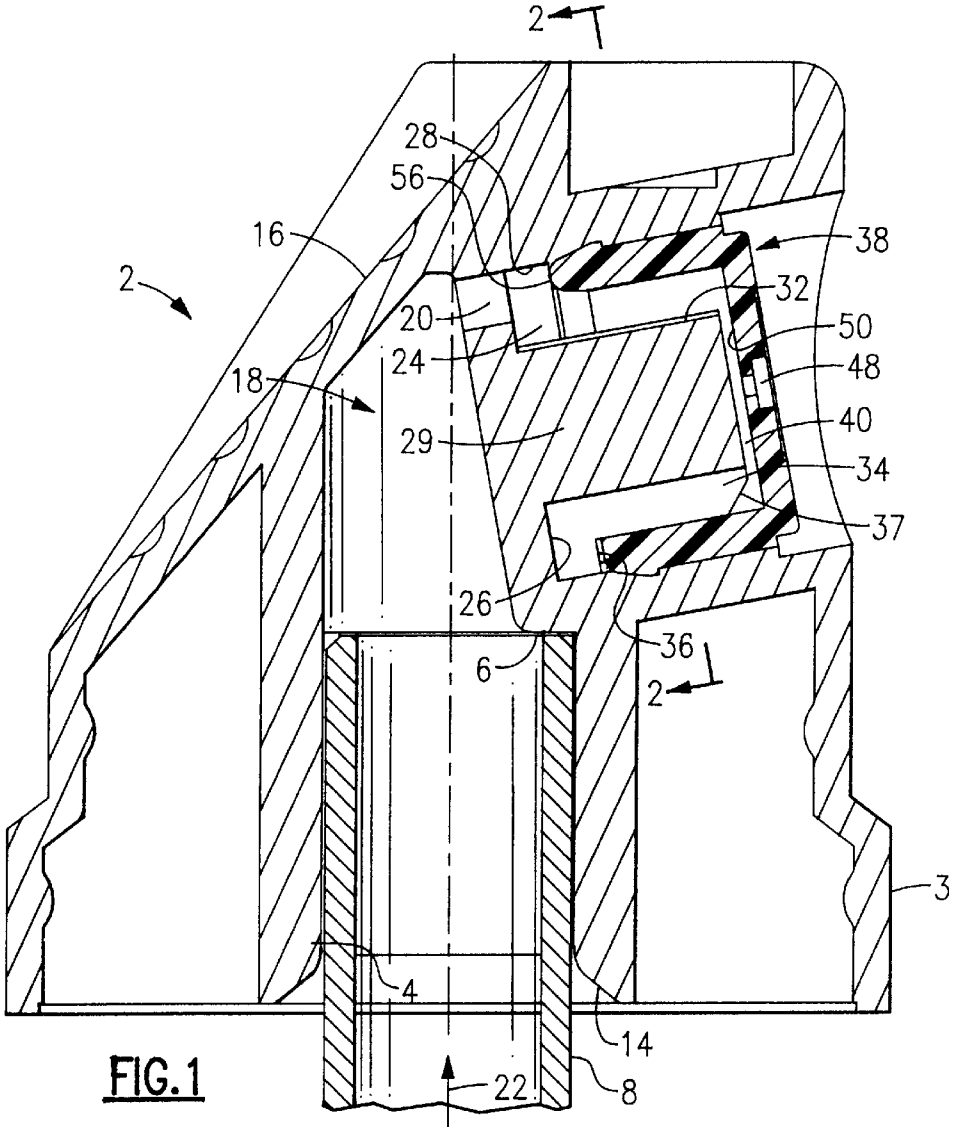
FIG. 1 is a diagrammatic cross-sectional view of a spray actuator according to the present invention.

Turning now to FIGS. 1 and 2, a detailed description concerning the improved spray actuator 2, according to the present invention, will now be provided. As can be seen in FIG. 1, the spray actuator 2 comprises an exterior housing 3 which is provided with an inlet 4, having a stop ledge 6, which matingly engage with a remote end of a stem 8 (only partially shown in this Figure) of a spray valve 10 supported by an aerosol or some other pressurized container 12 (see FIG. 6). The inlet 4 is provided with a perimeter chamfer 14 to facilitate receiving of the remote end of the stem 8 therein. The remote end of the stem 8 may also be chamfered. As the present invention specifically relates to improvements concerning the spray actuator, a further detailed description concerning the conventional spray valve and pressurized container is not provided.

A top exterior surface of the spray actuator 2 is provided with a recessed area 16 which is contoured to facilitate depression of the spray actuator 2 by an index finger, for example, of a user, once the spray actuator 2 is installed on a suitable aerosol or other pressurized container 12.

A passageway 18 extends from the inlet 4 to a discharge cavity opening 20. The inlet 4, the passageway 18 and the opening 20 facilitate conveyance of the pressurized product 22 from the stem 8 into a discharge cavity 24 of the spray actuator 2. The discharge cavity 24 is defined by a base surface 26 and an inwardly facing cylindrical side wall 28 of the housing 3. The base surface 26 has a cylindrical post 29 located centrally therein and integrally formed with the base surface 26. The discharge cavity 24 is opened at the end opposite the base surface 26.

An outwardly facing side wall 32 of the cylindrical post 29 carries a plurality of equally spaced support fins 34, e.g. three and possibly four or more equally spaced support fins. A portion of each one of the support fins 34, adjacent the base surface 26, is provided with a radially extending stop shoulder 36 while the opposed end of the fins 34 are provided with a chamfer 37 to facilitate receiving of an insert member 38. The support fins 34 are sized and located to facilitate centering of the cylindrical insert member 38 (FIG. 3) as it is received within the discharge cavity 24. The shoulders 36 prevent over-insertion of the insert member 38 into the discharge cavity 24, and a further description concerning the function and purpose of the same will follow below.

A remote planar end surface 40 of the cylindrical post 29 has a mechanical break-up 42 (FIGS. 4 and 5) integrally molded therein. The mechanical break-up 42, according to a first embodiment, has four substantially radially extending supply passages 44, each having a substantially constant cross sectional area. Each one of the supply passages 44 converges with a central section 46 of the mechanical break-up 42. The four radially extending supply passages 44 are each aligned tangentially with a perimeter region of the central section 46 to impart a tangential spin to the pressurized product 22 as it is discharged from the discharge cavity 24 into the central section 46 before the pressurized product 22 is discharged out through the discharge orifice 48 provided in the insert member 38. As this feature is well known in the art, a further detailed description concerning the same is not provided.

Figure 3:
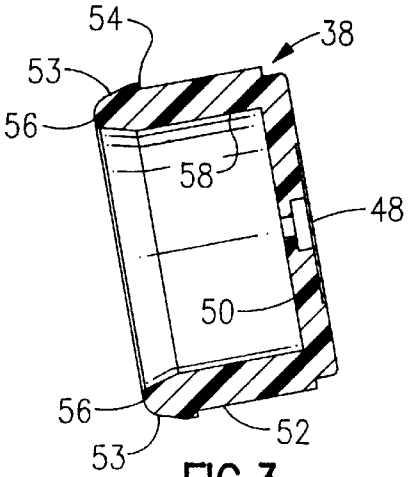
FIG. 3 is a diagrammatic transverse cross-sectional view of the insert member of FIG. 1 along the insert member's longitudinal axis.

The insert member 38 has a planar inwardly facing bottom surface 50 which has the discharge orifice 48 centrally located therein (FIG. 3). The insert member 38 has an inwardly facing cylindrical side wall 58 which mates, e.g. has a slight interference fit, with the fins 34 when the insert member 38 is received within the discharge cavity 24. An outwardly facing surface of the cylindrical side wall 52 supports an outwardly facing annular lip 54 which is provided to mate with the recess 17 of the inwardly facing cylindrical side wall 28 of spray actuator 2 of the discharge cavity 24. The annular lip 54 of the insert member 38 is sized to have an interference fit, e.g. a few thousands of an inch or so, with the inwardly facing cylindrical side wall 28 of the spray actuator 2 so that a "biting" action is achieved between those two components. Such "biting" action insures that the insert member 38, once appropriately received or inserted within the discharge cavity 24, will not be inadvertently removed therefrom.

The axial length of the side wall 52 of the insert member 38 and/or the axial height of the shoulders 36 of the fins 34 are selected such that when the insert member 38 is fully inserted into the discharge cavity 24, an end face 56 of the insert member 38 will abut against the shoulder or shoulders 36 of the support fins 34 and the planar inwardly facing bottom surface 50 of the insert member 38 will be abutted against the end surface 40 of the mechanical break-up 42 to ensure that the mechanical break-up 42 is sealed with respect to the insert member 38 so that the pressurized product must flow through the supply passages 44 in order to be discharged. However, the abutment between the planar inwardly facing bottom surface 50 of the insert member 38 and the end surface 40 of the mechanical break-up 42 must not sufficiently deform, compress or distort the mechanical break-up 42 thereby to significantly alter the flow characteristics of the pressurized product flowing through the mechanical break-up 42.

A chamfer 53 is provided between the end face 56 and the annular lip 54 of the insert member 38 to facilitate receiving the insert member 38 within the discharge cavity 24.

As the pressurized product 22 enters into the discharge cavity 24 from the opening 20, the pressurized product generally flows axially along the outwardly facing side wall 32 of the cylindrical post 29 and may also flow circumferentially around the cylindrical post 29, e.g. between the fins 34 and an inwardly facing surface 58 of the insert member 38, to ensure that the pressurized product 22 fills the entire discharge cavity 24 but does not leak passed the insert member 38. The primary flow of pressurized product 22 is axially along the outwardly facing surface of the cylindrical post 29 to a location closely adjacent the inwardly facing bottom surface 50 of the insert member 38. From there, the pressurized product 22 can flow circumferentially around the mechanical break-up 42, as the fins 34 do not project into this region, and a supply of pressurized product is ensured to an inlet of each one of the supply passages 44 of the mechanical break-up 42. This product feed arrangement facilitates a uniformed distribution of the pressurized product 22 to each one of the supply passages 44 of the mechanical break-up 42. Such uniform distribution of the pressurized product 22 ensures that the mechanical break-up 42 will impart the desired tangential spin to the pressurized product 22 prior to the pressurized product 22 being discharged out through the discharge orifice 48.

Figure 4:
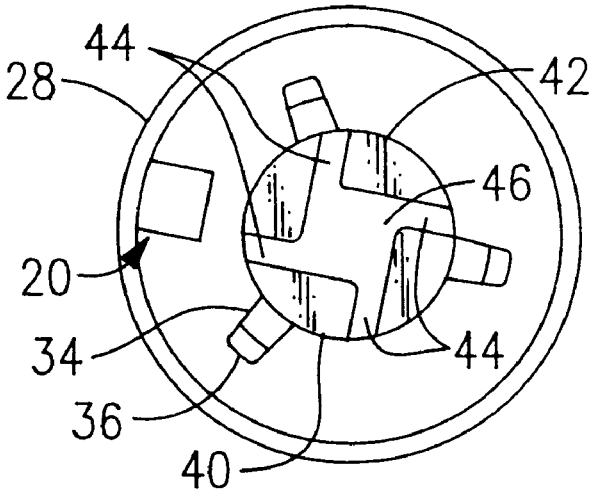
FIG. 4 is a diagrammatic plan view of the mechanical break-up of FIG. 1 with the insert member not shown for reasons of clarity.
Figure 5:
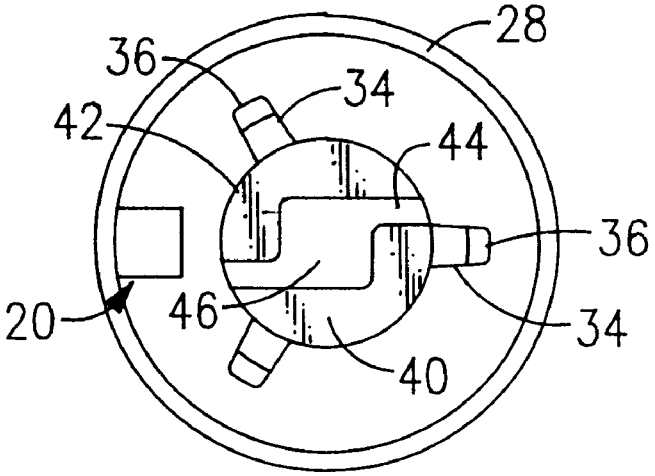
FIG. 5 is a diagrammatic plan view of a second embodiment of the mechanical break-up.

Although the mechanical break-up 42, shown in FIG. 4, has four supply passages 44 leading to the central section 46 of the mechanical break-up 42, it is to be appreciated that only two supply passages 44 (FIG. 5), three or any other desired number of supply passages 44 are also possible. As such teaching is well known in the art, a further detailed description concerning the same is not provided.

Figure 6:
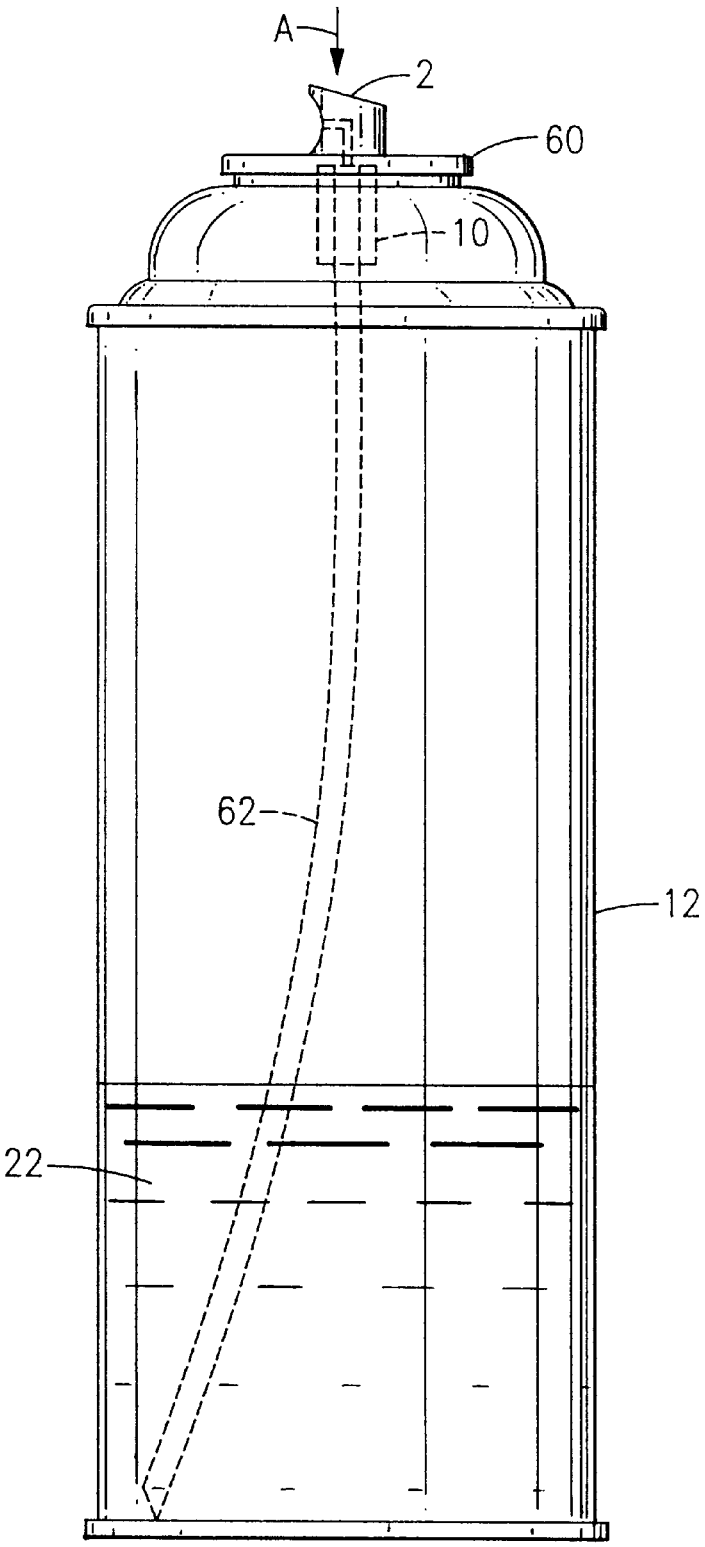
FIG. 6 is a diagrammatic representation showing the spray actuator, according to the present invention, mounted on a valve stem of a pressurized container.

Turning now to FIG. 6, a brief description concerning an application of the present invention will now be provided. As shown in this Figure, a conventional pressurized container 12 has a mounting cup 60 crimped, in a conventional manner, to an aperture provided in a top portion of the pressurized container 12. The mounting cup 60, in turn, has a valve 10 crimped, in a conventional manner, within a central aperture thereof and the valve 10 controls the flow of the pressurized product 22, in a conventional manner, from the pressurized container out through the stem of the valve 10. As such teaching is conventional and well known in the art, a further detailed description concerning these components is not provided.

The remote end of the valve stem 8 is received within the opening 4 of the spray actuator 2 (FIG. 1) and has an interference fit therewith to securely retain the engagement between these two components. Due to such engagement, when the spray actuator 2 is depressed in the direction of arrow A (FIG. 6) or suitably tilted (for a tilt valve), the valve stem 8 is, in turn, depressed or tilted (depending upon the kind of valve) and this commences the flow of the pressurized product 22 from the pressurized container 12 through a dip tube 62 into the valve 10 up through the valve stem 8, the passageway 18, the opening 20 and into the discharge cavity 24. From there, the pressurized product flows along the outwardly facing side wall 32 of the cylindrical post 29 and through the mechanical break-up 42. The pressurized product then flows along each one of the supply passages 44 into the central section 46 and finally out through the discharge orifice 48.

The above described arrangement, according to the present invention, simplifies the production of the mechanical break-up 42 for use with spray nozzles or spray actuators 2, such as hair spray, for example. In particular, the mechanical break-up 42 can be readily molded on the end face of the cylindrical post 29, during molding of the spray actuator 2, and miniaturized, e.g. have a height of about 0.01 inch or less. This arrangement also simplifies the production of the insert member 38 as the overall height of the insert member can be reduced, e.g. also miniaturized.

The support fins 34 and the shoulders 36 cooperate to center the insert member, during insertion of the insert member 38 into the discharge cavity 24, and prevent excess or gross overinsertion of the insert member 38 into the cavity 24 and thereby minimize the possibility that the mechanical break-up 42 will be significantly deformed, compressed or damaged during the manufacturing process. The present invention provides a high reliability spray actuator 2 and minimizes the amount of damaged and/or rejected spray actuators 2 during production.

The insert member 38 is preferably manufactured from a harder material, such as acetal, than the remainder of the spray actuator 2 which can be manufactured from a softer material, such as polyethylene or polypropylene.

Since certain changes may be made in the above described mechanical break-up for a spray actuator, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A spray actuator for dispensing a pressurized product, said spray actuator comprising:

a housing having an inlet communicating with a discharge orifice via both a passageway and a discharge cavity;

said discharge cavity being opened at one end and having a cylindrical post located therein, an outwardly facing surface of said cylindrical post supporting at least three spaced apart fins, and each of said at least three space apart fins extending radially and axially from said cylindrical post;

an end face of said post supporting a mechanical break-up having a plurality of radially extending supply passages for imparting a tangential flow to product as the product passes therethrough during actuation of said spray actuator;

an insert member having said discharge orifice formed therein, and said insert member being received within the opened end of said discharge cavity and having an interference fit with said discharge cavity to seal the opened end of said discharge cavity, and an inwardly facing bottom surface of said insert member abutting against said mechanical break-up to facilitate product flow through said mechanical break-up and out through said discharge orifice during actuation of said spray actuator; and at least one of said at least three fins having a radially extending stop shoulder located remote from said opened end, and an end face of said insert member abuts against said stop shoulder of said at least one fin of said at least three fins to prevent over-insertion of said insert member into said discharge cavity.

2. The spray actuator according to claim 1, wherein said insert member has a cylindrical side wall which has an outwardly facing annular lip, and said annular lip has an interference fit with said discharge cavity to seal and retain said insert member within said discharge cavity.

3. The spray actuator according to claim 1, wherein said mechanical break-up has at least one pair of opposed supply passages which communicate with said discharge orifice via a central section of said mechanical break-up.

4. The spray actuator according to claim 1, wherein said mechanical break-up is provided with two pairs of opposed supply passages, both said pairs of opposed supply passages communicate with said discharge orifice via a central section of said mechanical break-up, and said opposed two pairs of supply passages are aligned substantially perpendicular to one another.

5. The spray actuator according to claim 3, wherein said mechanical break-up has a height of about 0.01 inch or less.

6. The spray actuator according to claim 3, wherein at least an inwardly facing side wall, which defines said discharge cavity, is manufactured from a relatively soft material and said insert member is manufactured from a harder material than the material used to manufacture said inwardly facing side wall to facilitate permanent retention of said insert member within said discharge cavity.

7. The spray actuator according to claim 1, wherein an outwardly facing surface of the spray actuator is provided with a recessed area which is contoured to facilitate depression of said spray actuator by an index finger of a user.

8. The spray actuator according to claim 1, wherein said insert member has a planar inwardly facing bottom surface which has said discharge orifice centrally formed therein.

9. The spray actuator according to claim 1, wherein said insert member has an inwardly facing surface which engages with said fins to guide said insert member as said insert member is received within said discharge cavity.

10. The spray actuator according to claim 3, wherein each of said supply passages has a substantially constant cross sectional dimension and each said supply passage is aligned tangentially with a perimeter region of said central section to impart a tangential spin to the product as the product is discharged into said central section from said supply passage.

11. The spray actuator according to claim 4, wherein each of said supply passages has a substantially constant cross sectional dimension and each said supply passage is aligned tangentially with a perimeter region of said central section to impart a tangential spin to the product as the product is discharged into said central section from said supply passage.

12. The spray actuator according to claim 1, wherein said discharge cavity is defined by a base surface, an inwardly facing cylindrical side wall of said spray actuator, and said insert member, and said post is integrally formed with said base surface.

13. The spray actuator according to claim 8, wherein said inlet of said spray actuator is provided with a chamfer to facilitate receiving of a stem of an aerosol valve.

14. The spray actuator according to claim 11, in combination with a pressurized container provided with a valve which has a discharge stem, a pressurized product is contained within the pressurized container, and said spray actuator matingly engages with said stem to facilitate dispensing, upon actuation of said spray actuator, of the pressurized product from the pressurized container.

15. A spray actuator for dispensing a pressurized product, said spray actuator comprising:

a housing having an inlet communicating with a discharge orifice via both a passageway and a discharge cavity;

said discharge cavity being opened at one end and having a cylindrical post located therein, an outwardly facing surface of said cylindrical post supporting at least three spaced apart fins, and each of said at least three space apart fins extending radially and axially from the outwardly facing surface of said cylindrical post;

an end face of said post supporting a mechanical break-up having a plurality of radially extending supply passages for imparting a tangential flow to product as the product passes therethrough during actuation of said spray actuator;

an insert member having said discharge orifice formed therein, and said insert member being received within the opened end of said discharge cavity and having an interference fit with said discharge cavity to seal the opened end of said discharge cavity, and an inwardly facing planar bottom surface of said insert member abutting against said mechanical break-up to facilitate product flow through said mechanical break-up and out through said discharge orifice during actuation of said spray actuator;

each of said at least three fins having a radially extending stop shoulder being located remote from said opened end, and a planar end face of said insert member abutting against said stop shoulders of said at least three fins prevent over-insertion of said insert member into said discharge cavity; and an outwardly facing cylindrical side wall of said insert member having an annular lip, and said annular lip has an interference fit with a continuous inwardly facing cylindrical surface of said discharge cavity to seal said insert member with respect to said discharge cavity and retain said insert member within said discharge cavity.

16. A spray actuator for dispensing a pressurized product, said spray actuator comprising:

a housing having an inlet communicating with a discharge orifice via both a passageway and a discharge cavity;

said discharge cavity being opened at one end and having a cylindrical post located therein, an outwardly facing surface of said cylindrical post supporting only three spaced apart fins, and each of said three space apart fins extending radially and axially from the outwardly facing surface of said cylindrical post;

an end face of said post supporting a mechanical break-up having a plurality of radially extending supply passages for imparting a tangential flow to product as the product passes therethrough during actuation of said spray actuator; and an insert member having said discharge orifice formed therein, and said insert member being received within the opened end of said discharge cavity and having an interference fit with said discharge cavity to seal the opened end of said discharge cavity, and an inwardly facing planar bottom surface of said insert member abutting against said mechanical break-up to facilitate product flow through said mechanical break-up and out through said discharge orifice during actuation of said spray actuator;

each of said three fins having a radially extending stop shoulder being located remote from said opened end, and a planar end face of said insert member abutting against said stop shoulders of said three fins prevent over-insertion of said insert member into said discharge cavity; and an outwardly facing cylindrical side wall of said insert member having an annular lip, and said annular lip has an interference fit with a continuous inwardly facing cylindrical surface of said discharge cavity to seal said insert member with respect to said discharge cavity and retain said insert member within said discharge cavity.

* * * * *

UNITED STATES PATENT AND TRADEMARK OFFICE
CERTIFICATE OF CORRECTION

PATENT NO. : 5,992,765

DATED : November 30, 1999

INVENTOR(S) : Jeremy P. Smith

It is certified that error appears in the above-identified patent and that said Letters Patent is hereby corrected as shown below:

Title page, item [75], replace "Louden" with "Loudon"

Signed and Sealed this

Twenty-third Day of May, 2000

*Attest:*

Q. TODD DICKINSON

*Attesting Officer*

*Director of Patents and Trademarks*